US010341799B2

(12) United States Patent
Bharitkar et al.

(10) Patent No.: US 10,341,799 B2
(45) Date of Patent: Jul. 2, 2019

(54) IMPEDANCE MATCHING FILTERS AND EQUALIZATION FOR HEADPHONE SURROUND RENDERING

(71) Applicant: DOLBY LABORATORIES LICENSING CORPORATION, San Francisco, CA (US)

(72) Inventors: Sunil Bharitkar, Scotts Valley, CA (US); Louis D. Fielder, Millbrae, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 17 days.

(21) Appl. No.: 15/522,699

(22) PCT Filed: Oct. 28, 2015

(86) PCT No.: PCT/US2015/057906

§ 371 (c)(1),
(2) Date: Apr. 27, 2017

(87) PCT Pub. No.: WO2016/069809

PCT Pub. Date: May 6, 2016

(65) Prior Publication Data

US 2017/0339504 A1 Nov. 23, 2017

Related U.S. Application Data

(60) Provisional application No. 62/072,953, filed on Oct. 30, 2014.

(51) Int. Cl.
*H04S 3/00* (2006.01)
*H04S 7/00* (2006.01)

(52) U.S. Cl.
CPC ..... *H04S 3/004* (2013.01); *H04S 7/304* (2013.01); *H04S 7/302* (2013.01); *H04S 2400/01* (2013.01); *H04S 2420/01* (2013.01)

(58) Field of Classification Search
CPC ..... H04S 3/004; H04S 7/302; H04S 7/304; H04S 2400/01; H04S 2420/01; H04S 1/005
See application file for complete search history.

(56) References Cited

U.S. PATENT DOCUMENTS 3,920,904 A * 11/1975 Blauert ..... H04S 1/005 381/310
5,438,623 A * 8/1995 Begault ..... H04S 1/005 381/17

(Continued)

FOREIGN PATENT DOCUMENTS

| | | |
|---|---|---|
| WO | 1995/023493 | 8/1995 |
| WO | 97/25834 | 7/1997 |
| WO | 2013/124490 | 8/2013 |

OTHER PUBLICATIONS

Gardner et al., "HRTF Measurements of a KEMAR Dummy-Head Microphone", 1994-05, MIT Media Lab, Technical Report #280, pp. 1-7.*

(Continued)

*Primary Examiner* — Davetta W Goins
*Assistant Examiner* — Daniel R Sellers

(57) ABSTRACT

Embodiments are described for designing a filter in a magnitude domain performing an impedance filtering function over a frequency domain to compensate for directional cues for the left and right ears of the listener as a function of virtual source angles during headphone virtual sound reproduction. The filter is derived by obtaining blocked ear canal and open ear canal transfer functions for loudspeakers placed in a room, obtaining an open ear canal transfer function for a headphone placed on a listening subject, and dividing the loudspeaker transfer functions by the head- (Continued)

phone transfer function to invert a headphone response at the entrance of the ear canal and map the ear canal function from the headphone to free field.

20 Claims, 13 Drawing Sheets

(56) References Cited

U.S. PATENT DOCUMENTS

| | | | | |
|---|---|---|---|---|
| 6,072,877 | A | 6/2000 | Abel | |
| 6,118,875 | A | 9/2000 | Moeller | |
| 6,859,538 | B1 * | 2/2005 | Voltz | H04R 3/04 381/101 |
| 7,720,229 | B2 | 5/2010 | Duraiswami | |
| 8,081,769 | B2 | 12/2011 | Fukuda | |
| 8,428,269 | B1 | 4/2013 | Brungart | |
| 2006/0045294 | A1 * | 3/2006 | Smyth | H04S 7/304 381/309 |
| 2006/0120533 | A1 * | 6/2006 | Chen | H04S 1/002 381/17 |
| 2007/0270988 | A1 * | 11/2007 | Goldstein | H04R 5/04 700/94 |
| 2008/0140426 | A1 * | 6/2008 | Kim | G10L 19/008 704/500 |
| 2013/0003981 | A1 * | 1/2013 | Lane | H04S 7/301 381/58 |
| 2013/0236023 | A1 | 9/2013 | Horbach | |

OTHER PUBLICATIONS

Olive et al., "Listener Preference for Different Headphone Target Response Curves", May 4-7, 2013, 134th AES Convention, Convention Paper 8867, pp. 1-12.*

Moller, H. et al "Transfer Characteristics of Headphones Measured on Human Ears" Acoustics Laboratory, Aalborg University, Denmark, JAES vol. 43, Issue 4, pp. 203-217, Apr. 1, 1995.

Moller, H. et al "Design Criteria for Headphones" Acoustics Laboratory, Aalborg University, Denmark, JAES vol. 43, Issue 4, pp. 218-232, Apr. 1, 1995.

ITU-R BS.1116-1, "Methods for the Subjective Assessment of Small Impairments in Audio Systems Including Multichannel Sound Systems" (1994-1997).

Morse, P.M. "Theoretical Acoustics" Princeton University Press, 1986.

Hiipakka, M. et al "Estimating Head-Related Transfer Functions of Human Subjects from Pressure-Velocity Measurements" The Journal of the Acoustical Society of America, May 2012, pp. 4051-4061.

Algazi, V. Ralph, et al "Dependence of Subject and Measurement Position in Binaural Signal Acquisition" Journal of the Audio Engineering Society, New York, vol. 47, No. 11, pp. 937-947, Nov. 1, 1999.

Mickiewicz, W. et al "Headphone Processor Based on Individualized Head Related Transfer Functions Measured in Listening Room", AES presented at the 116th Convention, May 8-11, 2004, Berlin, Germany, pp. 1-6.

* cited by examiner

IMPEDANCE MATCHING FILTERS AND EQUALIZATION FOR HEADPHONE SURROUND RENDERING

CROSS REFERENCE TO RELATED APPLICATIONS

This application claims priority to U.S. Provisional Patent Application No. 62/072,953, filed on Oct. 30, 2014, which is hereby incorporated by reference in its entirety.

FIELD OF THE INVENTION

One or more implementations relate generally to surround sound audio rendering, and more specifically to impedance matching filters and equalization systems for headphone rendering.

BACKGROUND

Virtual rendering of spatial audio over a pair of speakers commonly involves the creation of a stereo binaural signal that represents the desired sound arriving at the listener's left and right ears and is synthesized to simulate a particular audio scene in three-dimensional (3D) space, containing possibly a multitude of sources at different locations. For playback through headphones rather than speakers, binaural processing or rendering can be defined as a set of signal processing operations aimed at reproducing the intended 3D location of a sound source over headphones by emulating the natural spatial listening cues of human subjects. Typical core components of a binaural renderer are head-related filtering to reproduce direction dependent cues as well as distance cues processing, which may involve modeling the influence of a real or virtual listening room or environment. One example of a present binaural renderer processes each of the 5 or 7 channels of a 5.1 or 7.1 surround in a channel-based audio presentation to 5/7 virtual sound sources in 2D space around the listener. Binaural rendering is also commonly found in games or gaming audio hardware, in which case the processing can be applied to individual audio objects in the game based on their individual 3D position. With the growing importance of headphone listening and the additional flexibility brought by object-based content (such as the Dolby® Atmos™ system), there is greater opportunity and need to have the mixers create and encode specific binaural rendering metadata at content creation time to maintain the spatial cues of the original content.

During headphone playback, matching the response at a person's ear drum to a free field response is important for recreating the perception of spatiality and obtaining the correct timbre. Unlike loudspeakers, headphones are generally not designed to have a flat frequency response but instead should compensate for the spectral coloration caused by the sound path to the ear. For correct headphone reproduction it is essential to control the sound pressure at the listener's ears, and there is no general consensus about the optimal transfer function and equalization of headphones. A great multitude of different headphone models can be derived to model playback through different types of headphones (e.g., open, closed, earbuds, in-ear monitors, hearing aids, and so on), and different directional placements. The creation and distribution of such models can be a challenge in environments that feature different audio playback scenarios, such as different client devices (e.g., mobile phones, portable or desktop computers, gaming consoles, and so on), as well as audio content (e.g., music, games, dialog, environmental noise, and so on).

What is needed, therefore, is an equalization system that enhances the perceptual quality and spatial representation of object-based audio content for playback through headphones. What is further needed is a system for efficiently defining and distributing headphone models for a variety of different headphone types and listening environments.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF EMBODIMENTS

Embodiments are described for systems and methods for designing a filter in a magnitude domain for filtering function over a frequency domain to compensate for directional cues for the left and right ears of the listening subject as a function of virtual source angles during headphone virtual sound reproduction by obtaining blocked ear canal and open ear canal transfer functions for loudspeakers placed in a room, obtaining an open ear canal transfer function for a headphone placed on a listening subject, and dividing the loudspeaker transfer functions by the headphone transfer function to invert a headphone response at the entrance of the ear canal and map the ear canal function from the headphone to free field. The method may further comprise constraining the frequency domain to a frequency range spanning a mid to high frequency range of the audible sound domain, wherein the frequency range is selected based on a degree of variation observed in the ratio due to transverse dimensions of the ear canal relative to the wavelength of sound transmitted to the listening subject. The filter may comprise a time-domain filter designed by modeling a magnitude response and phase using one of: a linear-phase design or minimum phase design. The smoothing of the magnitude response may by performed by a fractional octave smoothing function, such as either a ⅓ octave smoother or a ⅙ octave smoother.

In this method, the headphone is configured to playback audio content rendered through a digital audio processing system, and comprising channel-based audio and object-based audio including spatial cues for reproducing an intended location of a corresponding sound source in three-dimensional space relative to the listening subject. The method may comprise a measurement process in which the listening subject comprises a head and torso (HATS) manikin, the method further comprising: placing the manikin centrally in the room surrounded by the loudspeakers; placing the headphones on the manikin; transmitting acoustic signals through the loudspeakers and headphones for reception by microphones placed in or proximate the headphones; deriving measurements of the transfer functions by deconvolving the received acoustic signals with the transmitted signals to obtain binaural room impulse responses (BRIRs) for the loudspeaker blocked ear canal and open ear canal transfer functions; and converting the BRIRs to gated head related transfer function (HTRF) impulses. The method may also comprise placing subminiature microphones in cylindrical foam inserts placed in ear canal entrances of the manikin; measuring headphone sound response through the subminiature microphones; and correcting the headphone sound response to match a flat frequency response pressure microphone through a fractional octave smoothing and minimum-phase equalization component. The method may yet further comprise measuring a Headphone-Ear-Transfer-Function for each of a plurality of headphones by placing a selected headphone is on the manikin a plurality of times each; measuring a transfer function/impulse response for both ears for both ears of the manikin for each placement; and deriving an average response by RMS (root mean squared) averaging the magnitude frequency response of both ears and all placements for each respective headphone to generate a single headphone model for each headphone. The fractional (n) octave smoothing may be performed by one of: RMS averaging all the frequency components over a sliding-frequency, 1/n octave frequency interval or by a weighted RMS average, where the weighting is a sliding-frequency, prototypical 1/n octave frequency filter shape.

In an embodiment, the method comprises storing each headphone model in a networked storage device accessible to client computers and mobile devices over a network, and downloading a requested headphone model to a target client device upon request by the client device. The networked storage device may comprise a cloud-based server and storage system. The requested headphone model may be selected from a user of the client device through a selection application configured to allow the user to identify and download an appropriate headphone model; or it may be determined by automatically detecting a make and model of headphone attached to the client device, and downloading a respective headphone model as the requested headphone model based on the detected make and model of headphone, the headphone comprising one of an analog headphone and a digital headphone. The automatic detection may be performed by one of: measuring electrical characteristics of the analog headphone and comparing to known profiled electrical characteristics to identify a make and type of analog headphone, and using digital metadata definitions of the digital headphone to identify a make and type of digital headphone.

In the method, the client device comprises one of a client computing device, or a mobile communication device, and wherein the method further comprises applying the downloaded headphone model to a virtualizer that renders audio data through the headphones to the user.

Embodiments are further directed to a method comprising: deriving a base filter transfer curve for a headphone over a frequency domain to compensate for directional cues for the left and right ears of the listening subject as a function of virtual source angles during headphone virtual sound reproduction by obtaining blocked ear canal and open ear canal transfer functions for loudspeakers, obtaining an open ear canal transfer function for the headphone, and dividing the loudspeaker transfer functions by the headphone transfer function; deriving additional filter transfer curves for the headphone by changing placement of the headphone relative to a listening device; deriving an average response for the headphone by RMS (root mean squared) averaging the magnitude frequency response of the base filter transfer curve and additional filter transfer curves to generate a single headphone model for each headphone; and applying the average response to a virtualizer for rendering of audio content to a listener through the headphones.

Embodiments are yet further directed to a system comprising an audio renderer rendering audio for playback, a headphone coupled to the audio renderer receiving the rendered audio through a virtualizer function, and a memory storing a filter for use by the headphone, the filter configured to compensate for directional cues for the left and right ears of a listener as a function of virtual source angles during headphone virtual sound reproduction by obtaining blocked ear canal and open ear canal transfer functions for loudspeakers, obtaining an open ear canal transfer function for the headphone, and dividing the loudspeaker transfer functions by the headphone transfer function. The filter can be derived using an offline process and stored in a database accessible to a product or in memory in the product, and applied by a processor in a device connected to the headphones. Alternatively, the filters may be loaded into memory integrated in the headphone that includes resident processing and/or virtualizer componentry.

Embodiments are further directed to systems and articles of manufacture that perform or embody processing commands that perform or implement the above-described method acts.

BRIEF DESCRIPTION OF THE DRAWINGS

In the following drawings like reference numbers are used to refer to like elements. Although the following figures depict various examples, the one or more implementations are not limited to the examples depicted in the figures.

DETAILED DESCRIPTION

Systems and methods are described for virtual rendering of object-based audio over headphones, and impedance matching and equalization system for headphone surround rendering, though applications are not so limited. Aspects of the one or more embodiments described herein may be implemented in an audio or audio-visual system that processes source audio information in a mixing, rendering and playback system that includes one or more computers or processing devices executing software instructions. Any of the described embodiments may be used alone or together with one another in any combination. Although various embodiments may have been motivated by various deficiencies with the prior art, which may be discussed or alluded to in one or more places in the specification, the embodiments do not necessarily address any of these deficiencies. In other words, different embodiments may address different deficiencies that may be discussed in the specification. Some embodiments may only partially address some deficiencies or just one deficiency that may be discussed in the specification, and some embodiments may not address any of these deficiencies.

Figure 1:
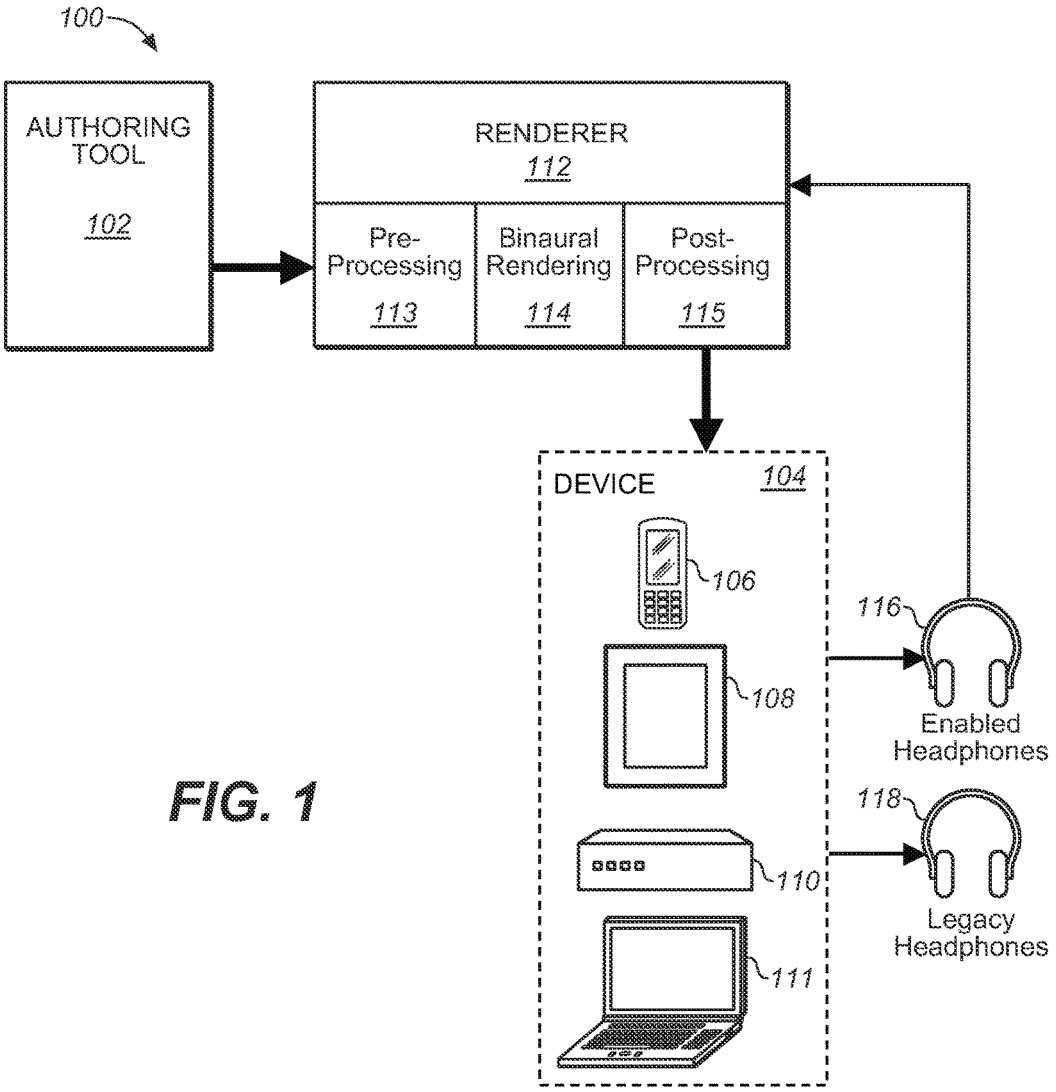
FIG. 1 illustrates an overall system that incorporates embodiments of a content creation, rendering and playback system, under some embodiments.

Embodiments are directed to an audio rendering and processing system including impedance filter and equalizer components that optimize the playback of object and/or channel-based audio over headphones. Such a system may be used in conjunction with an audio source that includes authoring tools to create audio content, or an interface that receives pre-produced audio content. FIG. 1 illustrates an overall system that incorporates embodiments of a content creation, rendering and playback system, under some embodiments. As shown in system 100, an authoring tool 102 is used by a creator to generate audio content for playback through one or more devices 104 for a user to listen to through headphones 116 or 118. The device 104 is generally a portable audio or music player or small computer or mobile telecommunication device that runs applications that allow for the playback of audio content. Such a device may be a mobile phone or audio (e.g., MP3) player 106, a tablet computer (e.g., Apple iPad or similar device) 108, music console 110, a notebook computer 111, or any similar audio playback device. The audio may comprise music, dialog, effects, or any digital audio that may be desired to be listened to over headphones, and such audio may be streamed wirelessly from a content source, played back locally from storage media (e.g., disk, flash drive, etc.), or generated locally. In the following description, the term "headphone" usually refers specifically to a close-coupled playback device worn by the user directly over his or her ears or in-ear listening devices; it may also refer generally to at least some of the processing performed to render signals intended for playback on headphones as an alternative to the terms "headphone processing" or "headphone rendering."

In an embodiment, the audio processed by the system may comprise channel-based audio, object-based audio or object and channel-based audio (e.g., hybrid or adaptive audio). The audio comprises or is associated with metadata that dictates how the audio is rendered for playback on specific endpoint devices and listening environments. Channel-based audio generally refers to an audio signal plus metadata in which the position is coded as a channel identifier, where the audio is formatted for playback through a pre-defined set of speaker zones with associated nominal surround-sound locations, e.g., 5.1, 7.1, and so on; and object-based means one or more audio channels with a parametric source description, such as apparent source position (e.g., 3D coordinates), apparent source width, etc. The term "adaptive audio" may be used to mean channel-based and/or object-based audio signals plus metadata that renders the audio signals based on the playback environment using an audio stream plus metadata in which the position is coded as a 3D position in space. In general, the listening environment may be any open, partially enclosed, or fully enclosed area, such as a room, but embodiments described herein are generally directed to playback through headphones or other close proximity endpoint devices. Audio objects can be considered as groups of sound elements that may be perceived to emanate from a particular physical location or locations in the environment, and such objects can be static or dynamic. The audio objects are controlled by metadata, which among other things, details the position of the sound at a given point in time, and upon playback they are rendered according to the positional metadata. In a hybrid audio system, channel-based content (e.g., 'beds') may be processed in addition to audio objects, where beds are effectively channel-based sub-mixes or stems. These can be delivered for final playback (rendering) and can be created in different channel-based configurations such as 5.1, 7.1.

As shown in FIG. 1, the headphone utilized by the user may be a legacy or passive headphone 118 that only includes non-powered transducers that simply recreate the audio signal, or it may be an enabled headphone 118 that includes sensors and other components (powered or non-powered) that provide certain operational parameters back to the renderer for further processing and optimization of the audio content. Headphones 116 or 118 may be embodied in any appropriate close-ear device, such as open or closed headphones, over-ear or in-ear headphones, earbuds, earpads, noise-cancelling, isolation, or other type of headphone device. Such headphones may be wired or wireless with regard to its connection to the sound source or device 104.

In an embodiment, the audio content from authoring tool 102 includes stereo or channel based audio (e.g., 5.1 or 7.1 surround sound) in addition to object-based audio. For the embodiment of FIG. 1, a renderer 112 receives the audio content from the authoring tool and provides certain functions that optimize the audio content for playback through device 104 and headphones 116 or 118. In an embodiment, the renderer 112 includes a pre-processing stage 113, a binaural rendering stage 114, and a post-processing stage 115. The pre-processing stage 113 generally performs certain segmentation operations on the input audio, such as segmenting the audio based on its content type, among other functions; the binaural rendering stage 114 generally combines and processes the metadata associated with the channel and object components of the audio and generates a binaural stereo or multi-channel audio output with binaural stereo and additional low frequency outputs; and the post-processing component 115 generally performs downmixing, equalization, gain/loudness/dynamic range control, and other functions prior to transmission of the audio signal to the device 104. It should be noted that while the renderer will likely generate two-channel signals in most cases, it could be configured to provide more than two channels of input to specific enabled headphones, for instance to deliver separate bass channels (similar to LFE 0.1 channel in traditional surround sound). The enabled headphone may have specific sets of drivers to reproduce bass components separately from the mid to higher frequency sound.

It should be noted that the components of FIG. 1 generally represent the main functional blocks of the audio generation, rendering, and playback systems, and that certain functions may be incorporated as part of one or more other components. For example, one or more portions of the renderer 112 may be incorporated in part or in whole in the device 104. In this case, the audio player or tablet (or other device) may include a renderer component integrated within the device. Similarly, the enabled headphone 116 may include at least some functions associated with the playback device and/or renderer. In such a case, a fully integrated headphone may include an integrated playback device (e.g., built-in content decoder, e.g. MP3 player) as well as an integrated rendering component. Additionally, one or more components of the renderer 112, such as the pre-processing component 113 may be implemented at least in part in the authoring tool, or as part of a separate pre-processing component.

Figure 2:
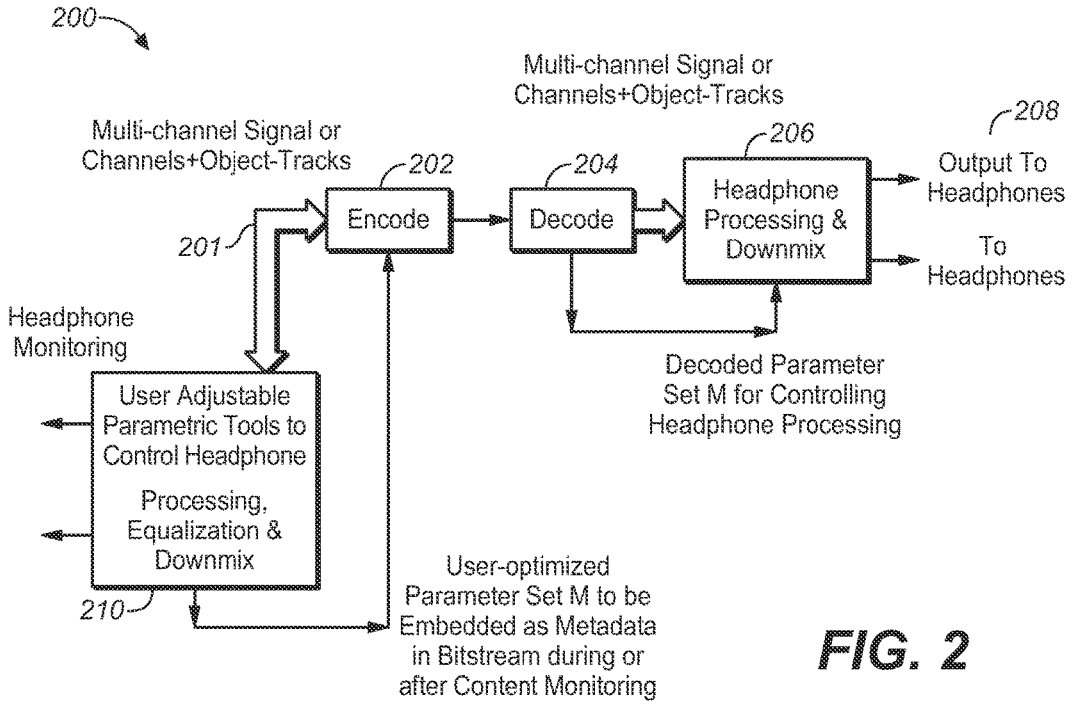
FIG. 2 is a block diagram that provides an overview of the dual-ended binaural rendering system, under an embodiment.

FIG. 2 is a block diagram of an example system that provides dual-ended binaural rendering system for rendering through headphones, under an embodiment. In an embodiment, system 200 provides content-dependent metadata and rendering settings that affect how different types of audio content are to be rendered. For example, the original audio content may comprise different audio elements, such as dialog, music, effects, ambient sounds, transients, and so on. Each of these elements may be optimally rendered in different ways, instead of limiting them to be rendered all in only one way. For the embodiment of system 200, audio input 201 comprises a multi-channel signal, object-based channel or hybrid audio of channel plus objects. The audio is input to an encoder 202 that adds or modifies metadata associated with the audio objects and channels. As shown in system 200, the audio is input to a headphone monitoring component 210 that applies user adjustable parametric tools to control headphone processing, equalization, downmix, and other characteristics appropriate for headphone playback. The user-optimized parameter set (M) is then embedded as metadata or additional metadata by the encoder 202 to form a bitstream that is transmitted to decoder 204. The decoder 204 decodes the metadata and the parameter set M of the object and channel-based audio for controlling the headphone processing and downmix component 206, which produces headphone optimized and downmixed (e.g., 5.1 to stereo) audio output 208 to the headphones. Although certain content dependent processing has been implemented in present systems and post-processing chains, it has generally not been applied to binaural rendering, such as illustrated in system 200 of FIG. 2. Authored and/or hardware-generated metadata may be processed in a binaural rendering component 114 of renderer 112. The metadata provides control over specific audio channels and/or objects to optimize playback over headphones 116 or 118.

In an embodiment, the rendering system of FIG. 1 allows the binaural headphone renderer to efficiently provide individualization based on interaural time difference (ITD) and interaural level difference (ILD). ILD and ITD are important cues for azimuth, which is the angle of an audio signal relative to the head when produced in the horizontal plane. ITD is defined as the difference in arrival time of a sound between two ears, and the ILD effect uses differences in sound level entering the ears to provide localization cues. It is generally accepted that ITDs are used to localize low frequency sound and ILDs are used to localize high frequency sounds, while both are used for content that contains both high and low frequencies.

In spatial audio reproduction, certain sound source cues are virtualized. For example, sounds intended to be heard from behind the listeners may be generated by speakers physically located behind them, and as such, all of the listeners perceive these sounds as coming from behind. With virtual spatial rendering over headphones, on the other hand, perception of audio from behind is controlled by head related transfer functions (HRTF) that are used to generate the binaural signal. In an embodiment, the metadata-based headphone processing system 100 may include certain HRTF modeling mechanisms. The foundation of such a system generally builds upon the structural model of the head and torso. This approach allows algorithms to be built upon the core model in a modular approach. In this algorithm, the modular algorithms are referred to as 'tools.' In addition to providing ITD and ILD cues, the model approach provides a point of reference with respect to the position of the ears on the head, and more broadly to the tools that are built upon the model. The system could be tuned or modified according to anthropometric features of the user. Other benefits of the modular approach allow for accentuating certain features in order to amplify specific spatial cues. For instance, certain cues could be exaggerated beyond what an acoustic binaural filter would impart to an individual.

Headphone Equalization

Figure 3:
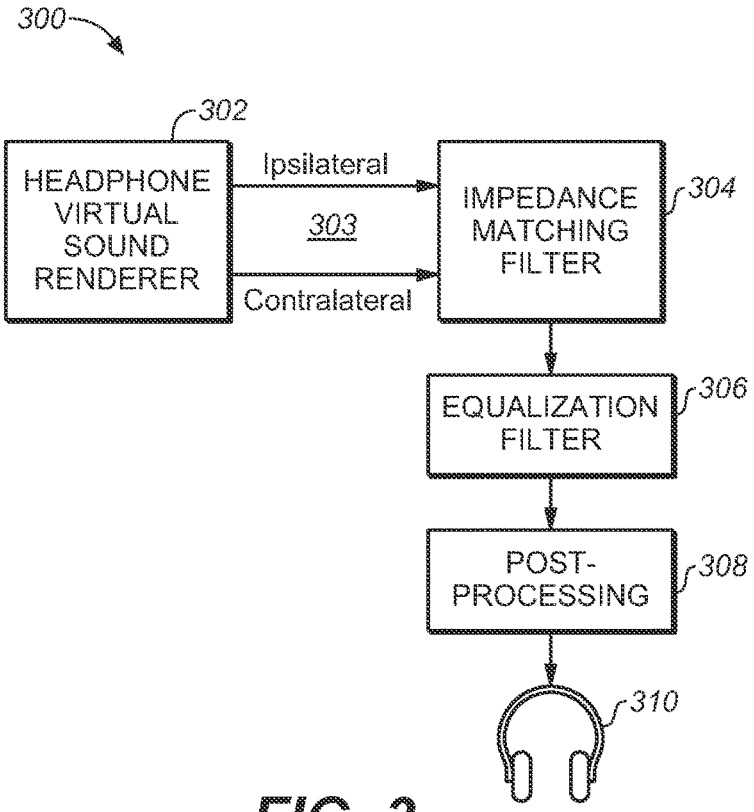
FIG. 3 is a block diagram of a headphone equalization system, under an embodiment.

As illustrated in FIG. 1, certain post-processing functions 115 may be performed by the renderer 112. One such post-processing function comprises headphone equalization. FIG. 3 is a block diagram of a headphone equalization system, under an embodiment. A headphone virtual sound renderer 302 outputs audio signals 303. An ear-drum impedance matching filter 304 provides directional filtering for the left and right ear as a function of virtual source angles during headphone virtual sound reproduction. The filters are applied to the ipsilateral and contralateral ear signals 303, for each channel, and equalized by an equalization filter 306 derived from blocked ear-canal measurements prior to reproduction from the corresponding headphone drivers of headphone 310. An optional post-processing block 308 may be included to provide certain audio processing functions, such as amplification, effects, and so on.

In general, the equalization function computes the Fast Fourier Transform (FFT) of each response and performs an RMS (root-mean squared) averaging of the derived response. The responses may be variable, octave smoothed, ERB smoothed, etc. The process then computes the inversion, $|F(\omega)|$, of the RMS average with constraints on the limits (+/−x dB) of the inversion magnitude response at mid- and high-frequencies. The process then determines the time-domain filter.

Figure 4:
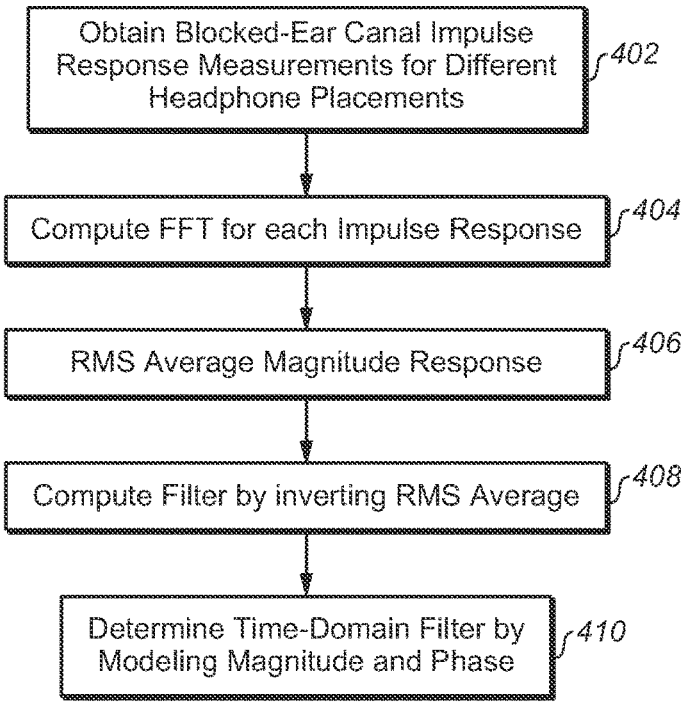
FIG. 4 is a flow diagram illustrating a method of performing headphone equalization, under an embodiment.
Figure 5:
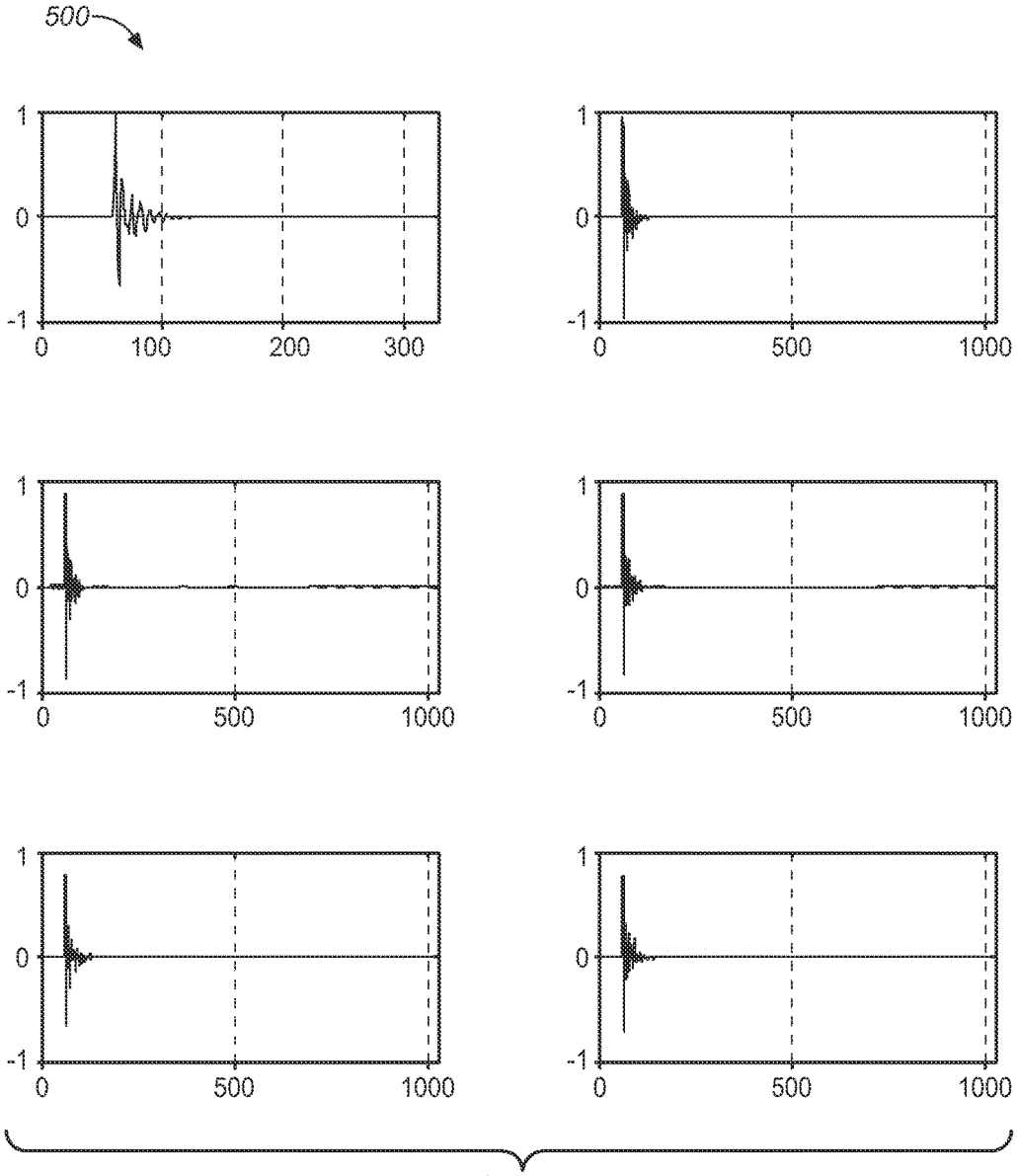
FIG. 5 illustrates an example case of three impulse response measurements for each ear, in an embodiment of a headphone equalization process.

FIG. 4 is a flow diagram illustrating a method of performing headphone equalization, under an embodiment. For the embodiment of FIG. 4, equalization is performed by obtaining blocked-ear canal impulse response measurements for different headphone placements for each ear, block 402. FIG. 5 illustrates an example case of three impulse response measurements for each ear, in an embodiment of a headphone equalization process.

Figure 6:
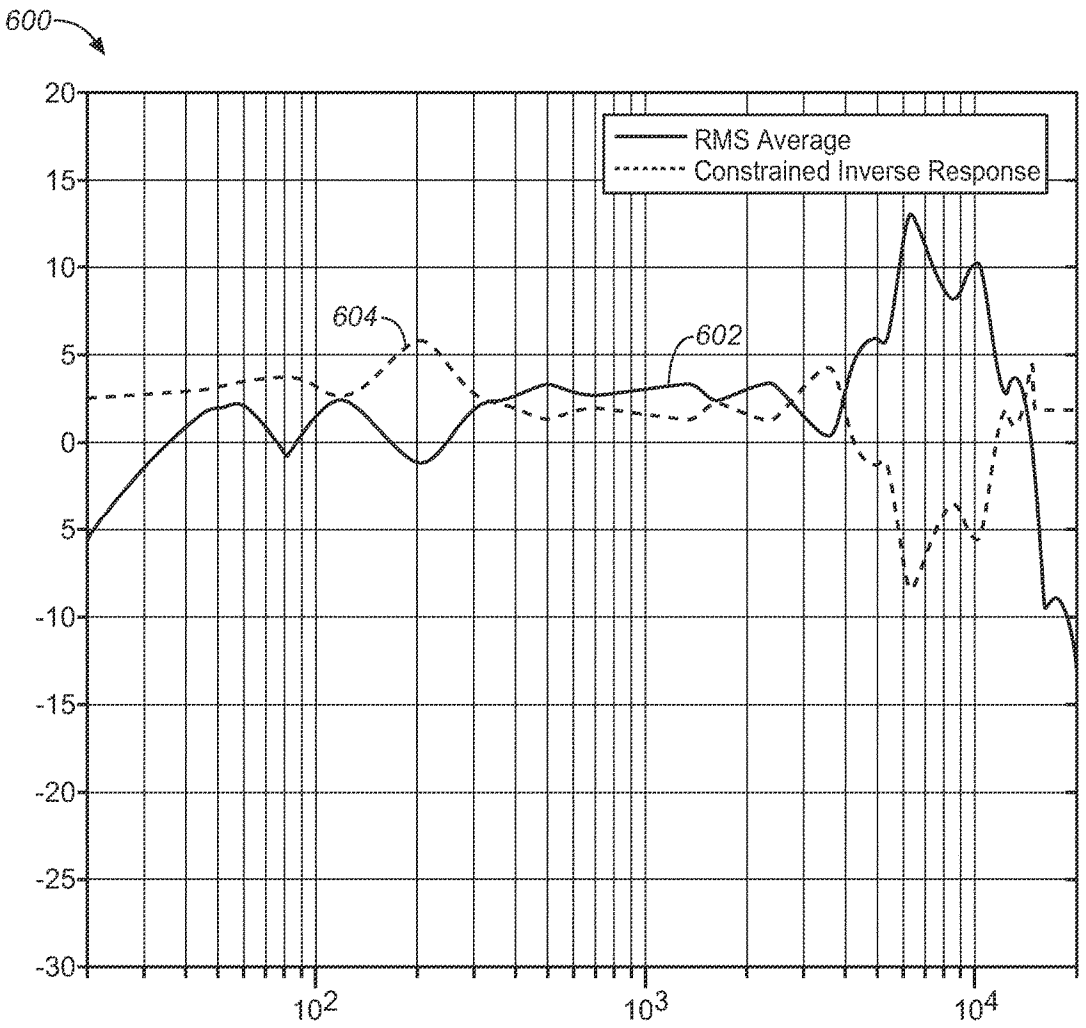
FIG. 6 illustrates an example magnitude response of an inverse filter, under an embodiment.

The process then computes the FFT for each impulse response, block 404, and performs an RMS averaging of the derived magnitude response, block 406. The responses may be smoothed (⅓ octave, ERB etc.). In block 408, the computes the filter value, $|F(\omega)|$, by inverting the RMS average with constraints on the limits+/−x dB of the inversion magnitude response. The process then determines the time-domain filter by modeling the magnitude and phase using either a linear-phase (frequency sampling) or minimum phase design. FIG. 6 illustrates an example magnitude response of an inverse filter that is constrained above 12 kHz to the RMS value between 500 Hz and 2 kHz of the inverse response. In diagram 600, plot 602 illustrates the RMS average response, and plot 604 represents the constrained inverse response.

Impedance Matching Filter

The post-process may also include a closed-to-open transform function to provide an impedance matching filter function 304. This pressure-division-ratio (PDR) method involves designing a transform to match the acoustical impedance between eardrum and free-field for closed-back headphones with modifications in terms of how the measurements are obtained for free-field sound transmission as a function of direction of arrival first-arriving sound. This indirectly enables matching the ear-drum pressure signals between closed-back headphones and free-field equivalent conditions without requiring complicated eardrum measurements. In an embodiment, a Pressure-Division-Ratio (PDR) for synthesis of impedance matching filter is used. The method involves designing a transform to match the acoustical impedance between ear-drum and free-field for closed-back headphones in particular. The modifications described below are in terms of how the measurements are obtained for free-field sound transmission expressed as function of direction of arrival of first-arriving sound.

Figure 7A:
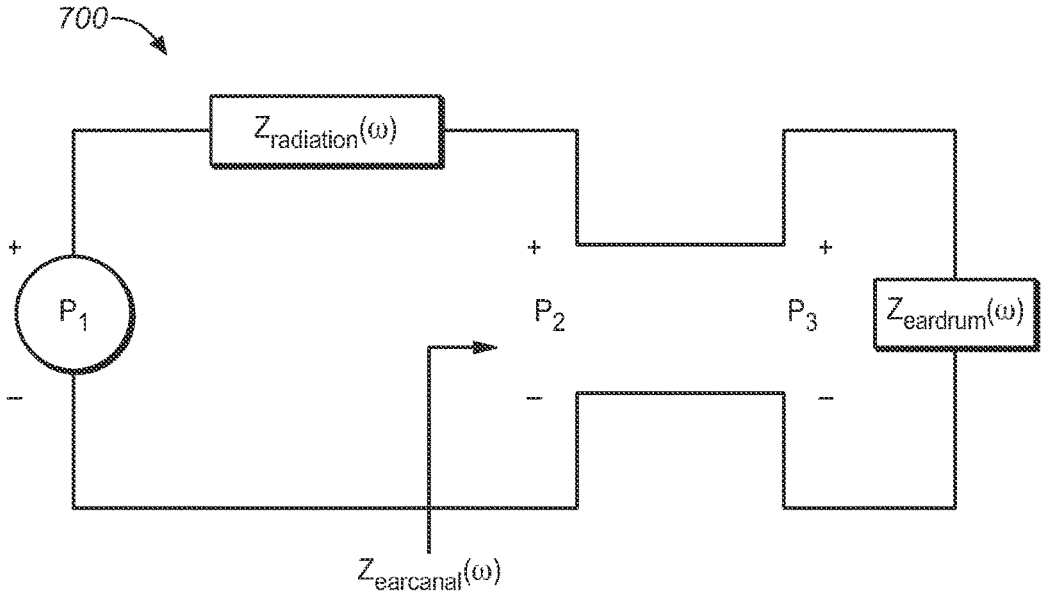
FIG. 7A illustrates a circuit for calculating the free-field sound transmission, under an embodiment.

FIG. 7A illustrates a circuit for calculating the free-field sound transmission, under an embodiment (free-field acoustical impedance analog model). Circuit 700 is based on a free-field acoustical impedance model. In this model, $P_1(\omega)$ is the Thevenin pressure measured at the entrance of the blocked ear canal with a loudspeaker at θ degrees about the median plane (e.g., about 30 degrees to the left and front of the listener) involving extraction of direct sound from the measured impulse response. Measurement $P_1(\omega)$ can be done at the entrance of the ear canal or at a certain distance X mm inside the ear canal (including at the eardrum) from the opening for the same loudspeaker at the same placement for measuring $P_1(\omega)$ involving extraction of direct sound from the measured impulse response. The measurement of $P_2(\omega,\theta)$ can be done at entrance of ear canal or at distance X mm inside the ear canal (including at eardrum) from opening for same loudspeaker for measuring $P_1(\omega,\theta)$ from where direct sound can be extracted.

For this model, the ratio of $P_2(\omega)/P_1(\omega)$ is calculated as follows:

$$\frac{P_2(\omega)}{P_1(\omega)} = \frac{Z_{eardrum}(\omega)}{Z_{eardrum}(\omega) + Z_{radiation}(\omega)}$$

Figure 7B:
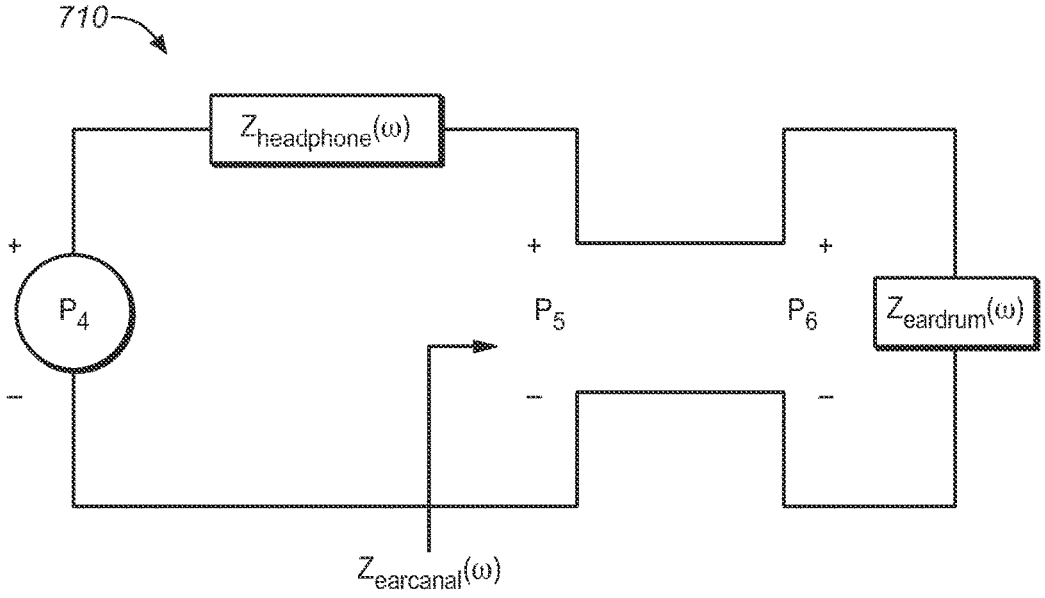
FIG. 7B illustrates a circuit for calculating the headphone sound transmission, under an embodiment.

In an embodiment, a headphone sound transmission (headphone acoustical impedance analog model) is used. FIG. 7B illustrates a circuit for calculating the headphone sound transmission, under an embodiment. Circuit 710 is based on a headphone acoustical impedance analog model. In this model, $P_4$ is measured at the entrance of the blocked ear canal with headphone (RMS averaged) steady-state measurement, and measure $P_5(\omega)$ is made at the entrance to the ear canal or at a distance inside the ear canal from the opening for the same headphone placement used for measuring $P_4(\omega)$.

For this model, the ratio of $P_5(\omega)/P_4(\omega)$ is calculated as follows:

$$\frac{P_5(\omega)}{P_4(\omega)} = \frac{Z_{eardrum}(\omega)}{Z_{eardrum}(\omega) + Z_{headphone}(\omega)}$$

The value $P_4(\omega)$ is measured at the entrance of the blocked ear canal with a headphone (RMS averaged) steady-state measurement. The measurement of $P_5(\omega)$ can be done at entrance to ear canal or at distance X mm inside ear canal (or at eardrum) from opening for same headphone placement used for measuring $P_4(\omega)$. The PDR is computed for both the left and right ears using Eq. 1 below:

$$\mathrm{PDR}(\omega,\theta)=P_{2,direct}(\omega,\theta)/P_{1,direct}(\omega,\theta)\div P_5(\omega)/P_4(\omega) \quad (1)$$

The PDR is computed for both the left and right ears. The filter is then applied in cascade with the equalization filter designed for the corresponding channel/driver (left or right) of the headphone (where the left headphone driver signal delivers audio to the left-L ear, and the right headphone driver delivers audio to the right-R ear). Accordingly, with the knowledge that the two headphone drivers are matched, Eq. 1 can be recast as PDR values associated with the left or right ear:

$$\mathrm{PDR}_L(\omega,\theta)=P_{2,direct,L}(\omega,\theta)/P_{1,direct,L}(\omega,\theta)\div P_5(\omega)/P_4(\omega) \quad (2a)$$

$$\mathrm{PDR}_R(\omega,\theta)=P_{2,direct,R}(\omega,\theta)/P_{1,direct,R}(\omega,\theta)\div P_5(\omega)/P_4(\omega) \quad (2b)$$

Equations (2a) and (2b) can be combined using the logical-OR (V) expression as:

$$\mathrm{PDR}_{LVR}(\omega,\theta)=P_{2,direct,LVR}(\omega,\theta)/P_{1,direct,LVR}(\omega,\theta)\div P_5(\omega)/P_4(\omega) \quad (3b)$$

Figure 8A:
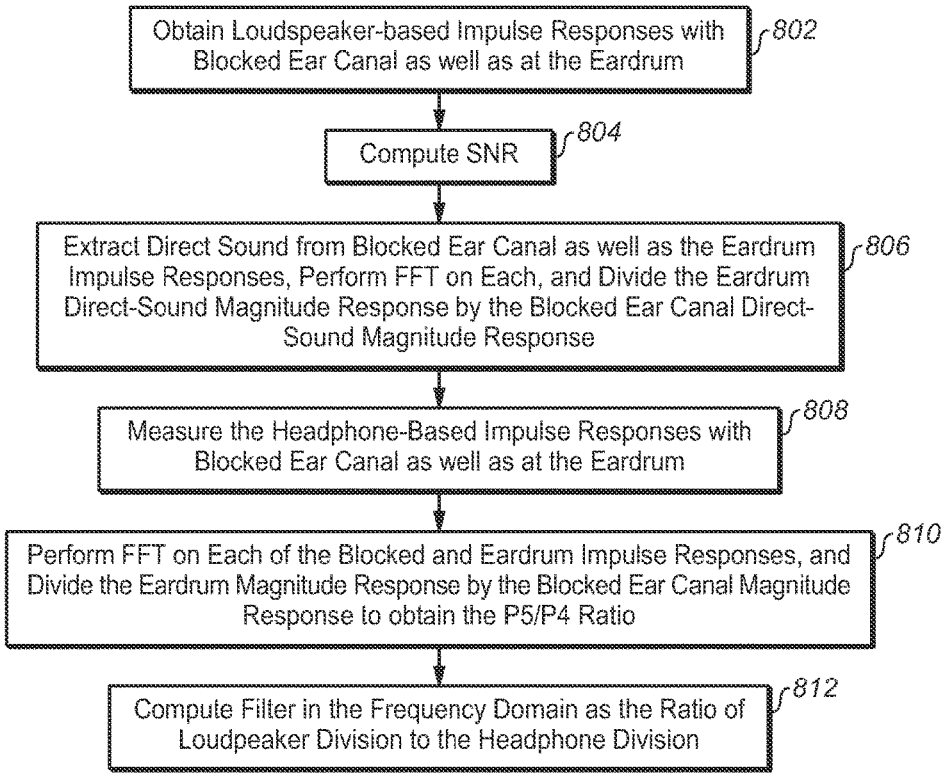
FIG. 8A is a flow diagram illustrating a method of computing the PDR from impulse response measurements under an embodiment.

FIG. 8A is a flow diagram illustrating a method of computing the PDR from impulse response measurements under an embodiment. Loudspeaker based impulse responses with blocked ear canal as well as at the eardrum are initially obtained, block 802. In block 804, the Signal-to-Noise Ratio (SNR) is calculated. The SNR can be determined by known techniques in the frequency domain (e.g., comparing the PSD of the loudspeaker generated stimulus to background noise) to ensure the measurement is above the noise floor by α dB. That is, the SNR is calculated to confirm reliability of the measurement. In block 806, the process extracts direct sound from the blocked ear canal as well as the ear drum impulse responses, performs FFT operations on each of them, and divides the direct-sound magnitude response by the blocked ear canal direct sound magnitude response. Subsequently, the headphone-based impulse responses with blocked ear canal as well as at the eardrum are measured, block 808. The process performs an FFT operation on each of the blocked and eardrum impulse responses, and divides the eardrum magnitude response by the blocked ear canal magnitude response to obtain the P5/P4 ratio, block 810. The directional transfer functions are power averaged to come up with a single filter. Thus, as shown in block 812, the filter is computed in the frequency domain as a ratio of loudspeaker division to the headphone division.

As shown in FIG. 3, the playback headphone 310 may be any appropriate close-coupled transducer system placed immediately proximate the listener's ears, such as open-back headphones, close-back headphones, in-ear devices (e.g., earbuds), and so on. In an embodiment, certain response test measurements were taken using a B&K HATS (dummy head and torso) measurement system to derive relevant differences between different headphone types.

Figure 9A:
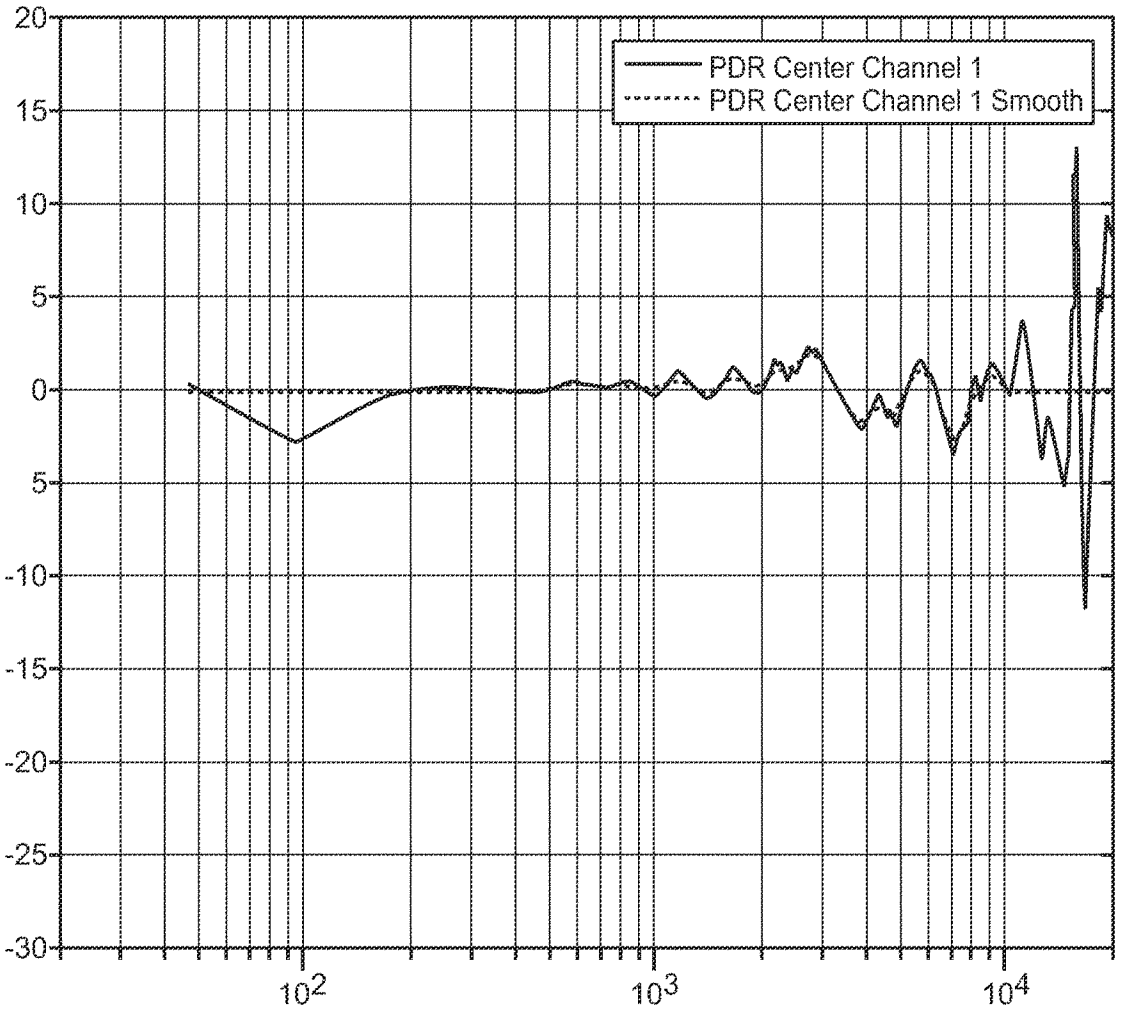
FIGS. 9A and 9B illustrate example PDR plots for an open-back headphone, under an embodiment.
Figure 9B:
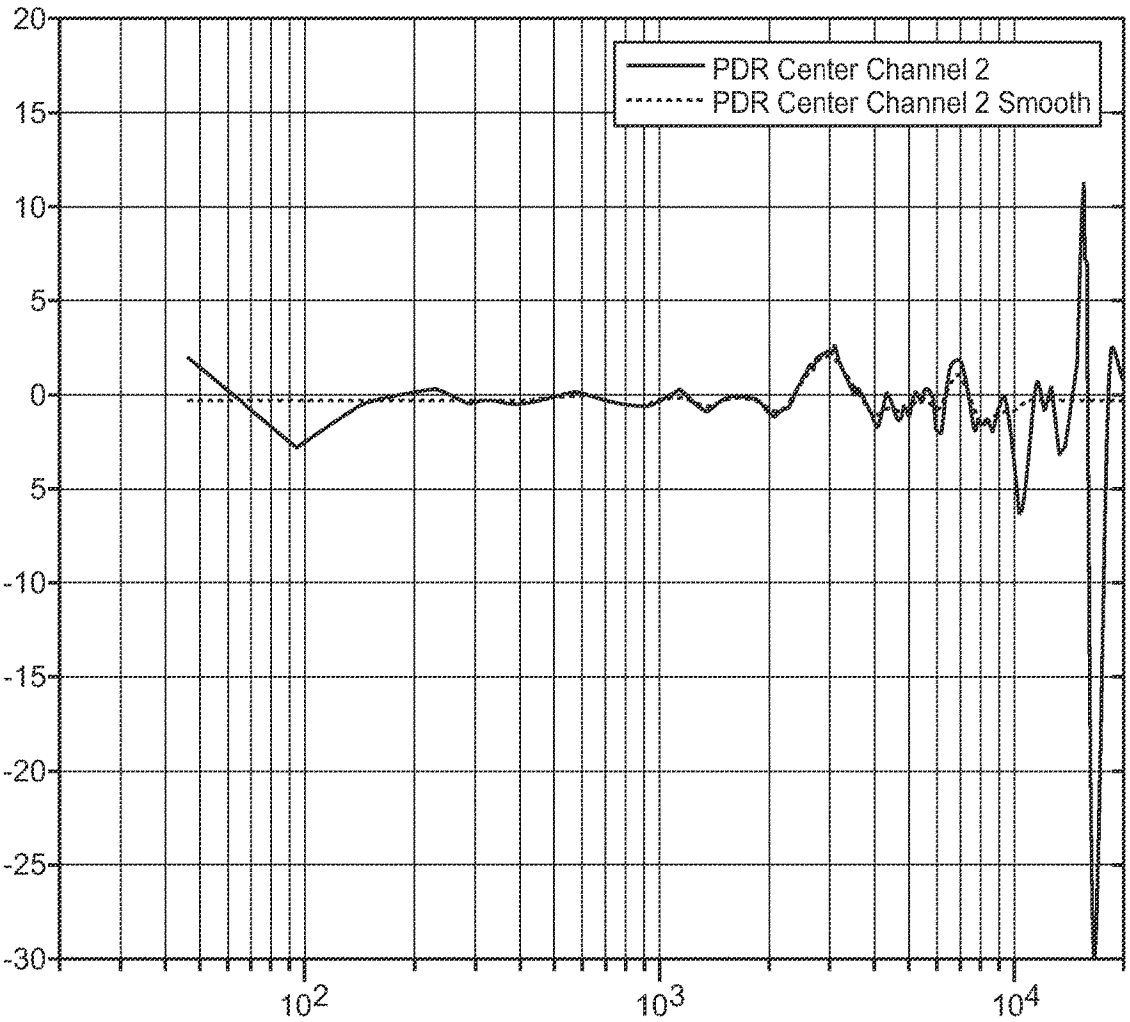

For open-back headphones, in theory, the acoustical impedance match between free-field and ear-drum and between headphone and ear-drum should be close to identical since the headphone impedance approximates the radiation impedance for "open" condition. This would result in a unity PDR. FIGS. 9A and 9B illustrates example PDR plots for an open-back Stax headphones, under an embodiment. FIG. 9A illustrates an example of the $\mathrm{PDR}_L(\omega,\theta)$ for a center loudspeaker (θ=0 degrees re: median plane of HATS dummy), $1/3^{rd}$ octave smoothed response constrained between 400 Hz and 10 kHz, and FIG. 9B illustrates an example of the $\mathrm{PDR}_R(\omega,\theta)$ for center loudspeaker (θ=0 degrees re: median plane of HATS dummy), $1/3^{rd}$ octave smoothed response constrained between 400 Hz and 10 kHz.

Similar plots and results were obtained for other angles for each L and R, such as θ=+30, −30, +110, and −110 degrees.

As found through the investigation, there is a directional element to the PDR from measurements obtained from an ITU loudspeaker setup (with the ITU setup being an example). This directional aspect manifests as different PDRs for the ipsilateral and contralateral ears as well as differences in PDRs for different channels (resulting in coupling differences by the individual ear-drums to source at angle θ in the free-field, with the angle θ being measured at center of head). The center loudspeaker exhibits a smaller difference in PDR between the ipsilateral and contralateral ears. The angular dependence is captured in a modified nomenclature of PDR(ω,θ). Accordingly, each of the headphone virtualized signals corresponding to a given channel/loudspeaker to the ipsi/contra-ear would need to be transformed by the corresponding ipsilateral and contralateral PDRs through the impedance filter associated with the angle of the loudspeaker.

In an embodiment, the impedance filter can be normalized to a hold amplitude value at higher frequencies to reduce the effect of non-uniform transmission associated with variability in headphone placements. Specifically, the amplitude is held at the amplitude of the bin value corresponding to the boundary frequencies, x and y Hz or to a mean amplitude value in between x and y Hz (where the interval between x and y Hz is the frequency region where PDR variations are observed). The smoothing may be done using n-th octave or ERB or variable octave. In the examples shown, the smoothing is done by a $\frac{1}{3}^{rd}$ octave smoother.

The closed-to-open transform |G(ω)| to give matched eardrum signals (matching between headphone and free-field) is expressed as:

$$G(\omega,\theta)=F|(\omega)||\mathrm{PDR}(\omega,\theta)||M(\omega)|^{-1}$$

where $|M(\omega)|^{-1}$ is the inverted microphone amplitude response. For FIGS. 9A and 9B, the example measurements were taken around a two-meter distance between the HATS manikin and the circular loudspeaker array at a reference position.

Figure 10A:
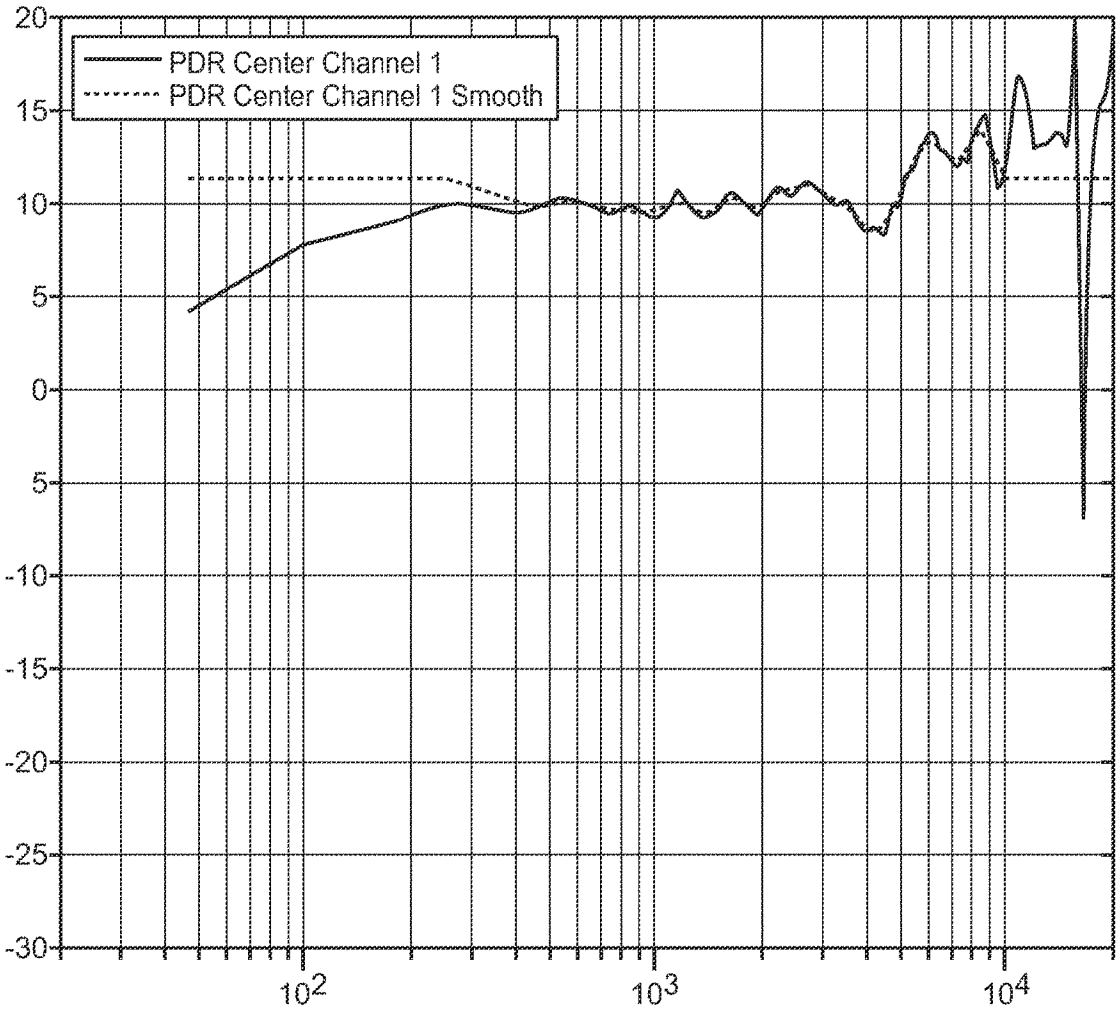
FIGS. 10A and 10B illustrate example PDR plots for a closed-back headphone, under an embodiment.
Figure 10B:
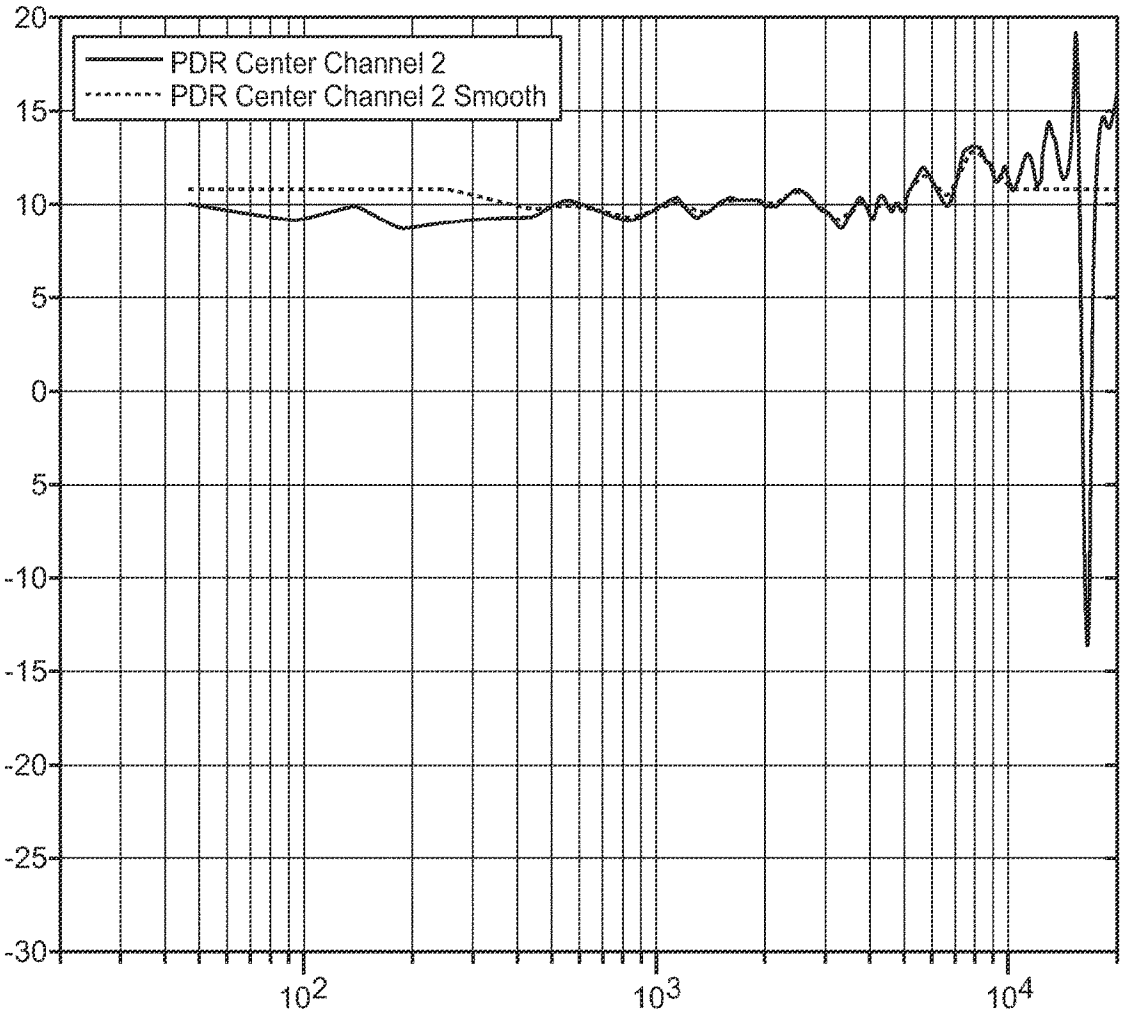

For purposes of comparison with the open-back headphone case, FIGS. 10A and 10B, illustrate example PDR plots for a closed-back headphone, under an embodiment. FIG. 10A $\mathrm{PDR}_L(\omega,\theta)$ for center loudspeaker (θ=0 degrees re: median plane of HATS dummy), $\frac{1}{3}^{rd}$ octave smoothed response constrained between 400 Hz and 10 kHz PDR, and FIG. 10B illustrates a $\mathrm{PDR}_R(\omega,\theta)$ for center loudspeaker (θ=0 degrees re: median plane of HATS dummy), $\frac{1}{3}^{rd}$ octave smoothed response constrained between 400 Hz and 10 kHz PDR. Similar plots and results were obtained for other angles for each L and R, such as θ=+30, −30, +110, and −110 degrees.

Ear Canal Mapping

In an embodiment, the synthesis of the impedance matching filter is performed using ear-canal mapping from the headphone to the free-field and headphone entrance to ear canal transfer function inversion. This is essentially a modification to the PDR method described above, and is a more realistic analogy for the synthesis process in most cases, since it does not involve a blocked canal measurement for the headphone. Measurements show that this approach using filters as obtained using the calculations of Eqs. 4a and 4b below are preferred over the above-described method for various content.

$$\mathrm{Pressuretransform}_L(\omega,\theta)=P_{2,direct,L}(\omega,\theta)/P_{1,direct,L}(\omega,\theta)\div P_5(\omega) \quad (4a)$$

$$\mathrm{Pressuretransform}_R(\omega,\theta)=P_{2,direct,R}(\omega,\theta)/P_{1,direct,R}(\omega,\theta)\div P_5(\omega) \quad (4b)$$

The denominator term ($P_5(\omega)$) of each of Eqs. 4a and 4b only have an open ear transfer function, and not the blocked ear transfer function. Directional dependence is maintained because the loudspeaker term is maintained. The denominator term equalizes the ear-drum measurement of the headphone. Specifically, the eardrum measurement of the headphone is represented as:

$$P_5(\omega)=(P_d(\omega)+P_r(\omega))_{hp\text{-}ec}P_{ec\text{-}ed}(\omega) \quad (5)$$

Note that the numerator in each of Eqs. 4a and 4b involves the pressure transform from entrance of ear-canal to ear-drum in a free-field condition, and the denominator includes the pressure transform from entrance of ear-canal to ear-drum, $P_{ec\text{-}ed}(\omega)$ in headphone condition of Eq. 3 (in addition to the headphone transfer function measure at the entrance to ear canal, the direct and reflected response, $(P_d(\omega)+P_r(\omega))_{hp\text{-}ec}$). The ratio in Eqs. 4a and 4b inverts the headphone response at the entrance of the ear canal and maps the ear-canal function from the headphone to free field. It should be noted that the correction is constrained to only the mid-frequency to high-frequency region since this region is where the largest variation is observed in the ratio due to the transverse dimensions of the ear canal relative to the wavelength of the sound. This region was defined by determining the location of the first two resonances in a tube (closed at one end) using the empirical formula for a quarter-wave resonator (a tube closed at one end). For an average ear-canal the diameter is d=2r~8 mm, the length L is ~25 mm, which translates to frequencies of:

$$f_n=nc/4(L+8r/3\pi)\ (n=1,3)\ f_1\approx 3\text{ kHz},\ f_2\approx 10\text{ kHz}$$

Note there are other equations such as the simplified quarter-wavelength equations and giving similar frequencies since L>>(8r/3π), such as:

$$f_n=nc/4(L)\ (n=1,3)\ f_1\approx 3\text{ kHz},\ f_2\approx 10\text{ kHz},$$

Figure 8B:
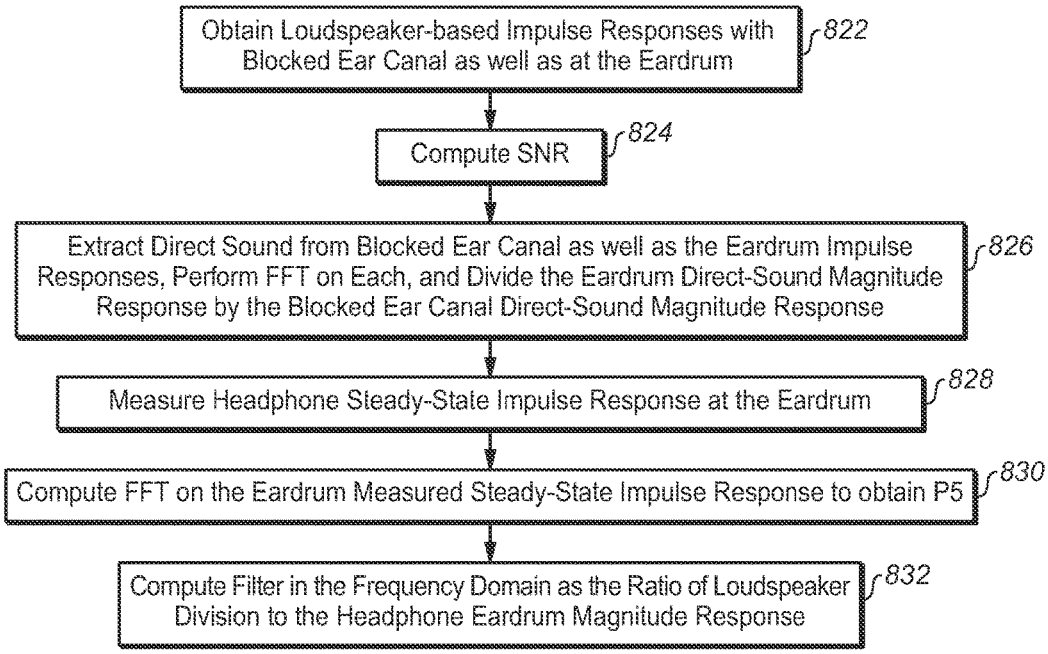
FIG. 8B is a flow diagram illustrating a method of computing the PDR from impulse response measurements under a preferred embodiment.

FIG. 8B is a flow diagram illustrating a method of computing the PDR from impulse response measurements under a preferred embodiment using the pressure transform equations 4a and 4b above. The process of FIG. 8B proceeds as shown in FIG. 8A for process steps 822 to 826 with the obtaining of loudspeaker based impulse responses with blocked ear canal and at the ear-drum (822), the calculation of the SNR (824), and the extraction of direct sound from blocked ear canal and eardrum impulse responses, FFT operations on both, and the dividing of the eardrum direct-sound magnitude response by the blocked ear canal direct sound magnitude response (826). Next in FIG. 8B, the headphone-based steady-state impulse response is measured at the eardrum, block 828. In block 830, the process performs an FFT operation on the eardrum measured steady-state impulse response to obtain P5. The filter is then computed in the frequency domain as the ratio of loudspeaker division to the headphone eardrum magnitude response.

Measurement Process

The binaural room impulse response (BRIR) transfer functions for the blocked canal and ear drum conditions were obtained by placing a HATS manikin in the center of a room of a certain size (e.g., 14.2' wide by 17.6' long by 10.6' high) surrounded by the source loudspeakers. Similarly, the headphone measurements were made by placing the headphones on the manikin. The manikin ears were set at a specific height (e.g., 3.5') from the floor and the acoustic centers of the loudspeakers were set at approximately that same height and a set distance (e.g., 5') from the center of the manikin head. In a specific example configuration, seven horizontal loudspeakers were placed a 0°, ±30°, ±90°, and ±135° azimuth, at 0° elevation, while two height loudspeakers were placed at ±90° azimuth and 63° elevation. Other speaker configurations and orientations are also possible.

The measurements of the transfer functions were made by deconvolution of the received acoustic signals with the source four-second long exponential sweep in a 5.46 second long file. The BRIRs were trimmed to 32768 samples long and then further converted to head-related transfer function (HRTF) impulses by time gating the BRIRs to only include the first two milliseconds from the direct arrival sound, followed by 2.5 milliseconds of fade down interval.

Two measurements were made for each source loudspeaker location and headphone fitting. First the internal "ear drum" microphones of the manikin were used for the ear drum measurements. Next, the blocked measurements were made by the use of subminiature microphones (e.g., Sonion 8002MP) placed in small cylindrical foam inserts so that both microphone diaphragms were flush with the manikin conchae and completely sealing the manikin ear canal entrances. The responses of these microphones were also corrected to match a flat frequency response pressure microphone (e.g., B&K ⅛$^{th}$ 4138) via ⅓-octave smoothed, minimum-phase equalization covering the 50-15,000 Hz frequency range.

Figure 11:
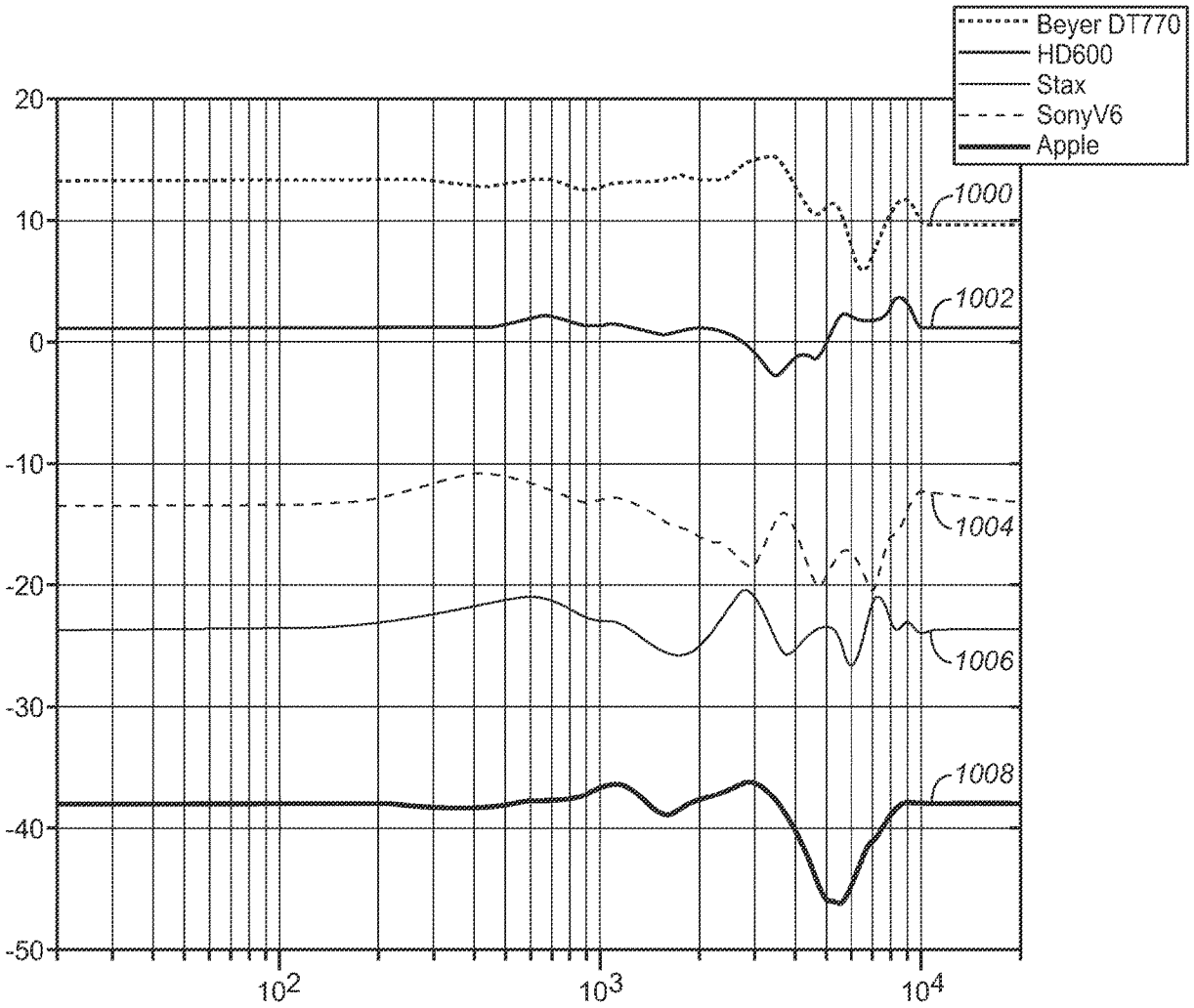
FIG. 11 illustrates an example of directionally averaged filters designed using a filter derivation method, under an embodiment.

FIG. 11 illustrates an example of directionally averaged filters designed using this method. The plots of FIG. 11 illustrate the filters for various different makes of headphones, and represent curves that are averaged over a number of different placements per headphone on the manikin. Plot 1000 corresponds to a Beyer DT770 closed-back headphone, plot 1002 corresponds to a Sennheiser HD600 headphone, plot 1004 corresponds to a SonyV6 closed-back headphone, plot 1006 corresponds to a Stax open-back headphone, and plot 1008 corresponds to an Apple earbud. These plots are intended to be examples only, and many other types and makes of headphones are also possible. As can be seen in the plots of FIG. 11, the open-backed headphones (e.g., Stax and Sennheiser) exhibit relatively less deviation, indicating that they are less sensitive to directional effects than the other types of headphones.

With regard to the test data measurements and filter design, the divisions between loudspeaker and headphone measurements, leads to a filter in the magnitude domain. The filter is designed over frequency domain [x1, x2] Hz. The filter is constrained in the range (y-axis) to be set at a value of 20*log 10(abs(H(x1))) for all frequencies x<x1 through DC, and is constrained to a value of 20*log 10(abs(H(x2))) for all frequencies x>x2 through Nyquist. Other options are also possible, and not precluded by the specific example values provided herein, such as constraining to 0 dB, constraining to the mean value between x1 and x2 or between 500 Hz and 2 kHz. One example case keeps the values x1 and x2 as 500 Hz and 9 kHz respectively. As can be appreciated by those of ordinary skill in the art, there can be multiple ways to design the filter in the time domain.

After constraining, proper bins are set to values above the Nyquist rate before the inverse FFT process. A frequency sampling approach (e.g., fir2 in matlab) could be used to approximate the frequency response from DC to Nyquist.

In an example embodiment, the basic measurement process comprises measuring the transfer function embodied by a 48 kHz sample rate impulse response. This impulse response is measured by the use of a four-second exponential chirp in a 5.46-second file, where the measured signal is deconvolved with the source signal to result in the impulse response. This impulse response is trimmed to result in a 32768-sample impulse response where the direct arrival impulse is located a few hundred samples from the beginning of the source file. The source file is used to either drive each channel of the headphone or the appropriate loudspeaker, while the measured signal is taken from the internal "ear drum" or blocked-canal microphone in a HATS manikin (e.g., B&K 4128 HATS manikin). The magnitude frequency response is measured by taking the Fast Fourier Transform (FFT) of the impulse response and finding the magnitude component of the FFT frequency bins.

For the measurement of the Headphone-Ear-Transfer-Function $P_5(\omega)$, a selected headphone is placed on the HATS manikin multiple times or fittings and the transfer function/impulse response measured for both ears. An average response is obtained by RMS averaging the magnitude frequency response of both ears and all fittings for that particular headphone. Fractional-octave smoothing (e.g., ⅓ octave smoothing) is performed by RMS averaging all the frequency components over a sliding-frequency, ⅓ octave frequency interval or by a weighted RMS average, where the weighting can be a sliding-frequency, prototypical ⅓ octave frequency filter shape.

For the measurement of the Head-Related-Transfer-Functions (HRTFs) to the Ear Drum $P_2(\omega)$ or Blocked Ear Canal $P_1(\omega)$, the HATS manikin is placed in the center of a room, away from the walls, ceiling, and floor surfaces. Loudspeakers are individually driven by the source signal and then signals at the HATS "ear drum" microphones are used to derive the "Ear Drum" impulse responses for both ears. Alternately, the transfer functions for the blocked canal condition are obtained by placing a foam plug at the ear canal entrance and a small microphone in the center, where both the microphone diaphragm and the foam plug surface are flush with the manikin conchae. These microphones are equalized to be flat over the audible frequency range and the signals from these microphones are combined with the source signals to create the blocked canal impulse responses. These impulse responses are converted to HRTFs by removing all room reflections by only including the first two millisecond time interval after the first arrival sounds, followed by a 2.5 millisecond fade down to zero.

In an embodiment, an automated process is implemented that allows for detection and identification of headphone model/make and which would enable download of appropriate headphone filter coefficients. The device connected to a host could be identified based on manufacturer, make. Such a detection and identification protocol may be provided by the communication system coupling the headphones to the system, such as through USB bus, Apple Lightning connector, and so on. For this embodiment, a device descriptor table using class codes for various interfaces and devices may be used to specify product IDs, vendors, manufacturers, versions, serial numbers, and other relevant product information.

Figure 12:
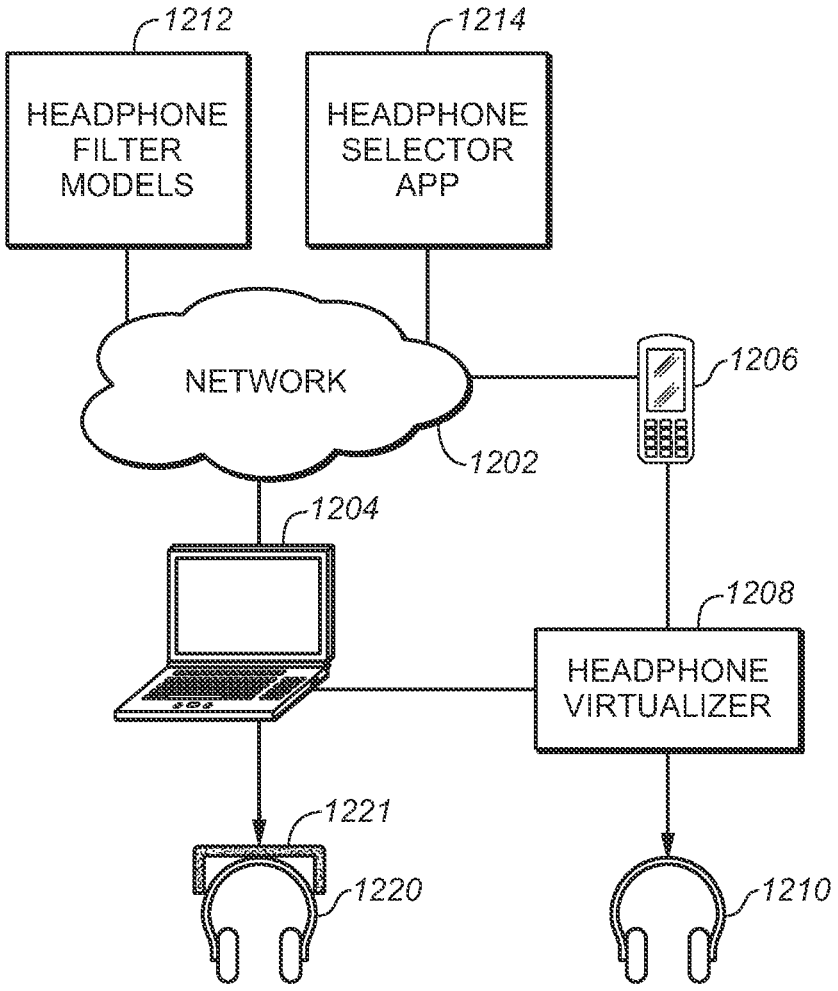
FIG. 12 is a block diagram of a system implementing a headphone model distribution and virtualizer method, under an embodiment.

FIG. 12 is a block diagram of a system implementing a headphone model distribution and virtualizer method, under an embodiment. In an embodiment, various headphone filter models 1212 for a variety of different headphones (e.g., headphone 1210) are stored in a networked storage device accessible to client computers 1204 and mobile devices 1206 over a network 1202, and downloading a requested headphone model to a target client device upon request by the client device. The networked storage device may comprise a cloud-based server and storage system. The requested headphone model may be selected from a user of the client device through a selection application 1214 configured to allow the user to identify and download an appropriate headphone model. Alternatively, it may be determined by automatically detecting a make and model of headphone attached to the client device, and downloading the appropriate headphone model based on the detected make and model of headphone. The automatic detection process may be configured depending on the type of headphone. For example, for analog headphones automatic detection may involve measuring electrical characteristics of the analog headphone and comparing to known profiled electrical characteristics to identify a make and type of the target analog headphone. For digital headphones, digital metadata definitions may be used to identify a make and type of digital headphone for systems that encode such information for use by networked devices. For example, the Apple Lightning digital interface, and certain USB interfaces encode the make and model of devices and transmit this information through metadata definitions or indices to lookup tables.

For the embodiment of FIG. 12, the method and system further comprises applying the downloaded headphone model to a virtualizer that renders audio data through the headphones to the user. The virtualizer 1208 uses the downloaded headphone model to properly render the spatial cues for the object and/or channel-based (e.g., adaptive audio) content by providing directional filtering for the left and right ear drivers of headphone 1210 as a function of the virtual source angles. The filter function is applied to the ipsilateral and contralateral ear signals for each channel.

In one embodiment the filter models can be derived using an offline process and stored in a database accessible to a product or in memory in the product, and applied by a processor in a device connected to the headphones 1210 (e.g., virtualizer 1208). Alternatively, the filters may be applied to a headphone set that includes resident processing and/or virtualizer componentry, such as headphone set 1220, which is a headphone that includes certain on-board circuitry and memory 1221 sufficient to support and execute downloaded filters and virtualization, rendering or post-processing operations.

Aspects of the methods and systems described herein may be implemented in an appropriate computer-based sound processing network environment for processing digital or digitized audio files. Portions of the adaptive audio system may include one or more networks that comprise any desired number of individual machines, including one or more routers (not shown) that serve to buffer and route the data transmitted among the computers. Such a network may be built on various different network protocols, and may be the Internet, a Wide Area Network (WAN), a Local Area Network (LAN), or any combination thereof. In an embodiment in which the network comprises the Internet, one or more machines may be configured to access the Internet through web browser programs.

One or more of the components, blocks, processes or other functional components may be implemented through a computer program that controls execution of a processor-based computing device of the system. It should also be noted that the various functions disclosed herein may be described using any number of combinations of hardware, firmware, and/or as data and/or instructions embodied in various machine-readable or computer-readable media, in terms of their behavioral, register transfer, logic component, and/or other characteristics. Computer-readable media in which such formatted data and/or instructions may be embodied include, but are not limited to, physical (non-transitory), non-volatile storage media in various forms, such as optical, magnetic or semiconductor storage media.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

While one or more implementations have been described by way of example and in terms of the specific embodiments, it is to be understood that one or more implementations are not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A method comprising:

obtaining blocked ear canal and open ear canal transfer functions for each ear of a listening subject for loudspeakers placed in a room, wherein for each ear the blocked ear canal transfer function for a respective loudspeaker is the transfer function from the respective loudspeaker to a first microphone located at an entrance of a blocked ear canal of the respective ear, and for each ear the open ear canal transfer function for the respective loudspeaker is the transfer function from the respective loudspeaker to a second microphone located inside the ear canal of the respective ear;

obtaining an open ear canal transfer function for each ear of the listening subject for a headphone placed on the listening subject as a headphone transfer function, wherein for each ear the open ear canal transfer function for the headphone is the transfer function from the headphone to the respective second microphone;

obtaining, for each ear, a ratio of the open ear canal transfer function for the loudspeakers and the blocked ear transfer function for the loudspeakers as a ratio of loudspeaker transfer functions;

dividing, for each ear, the ratio of the loudspeaker transfer functions by the headphone transfer function to invert a headphone response at the entrance of the ear canal and map the ear canal function from the headphone to free field; and computing, for each ear, a frequency-domain filter as the result of the division for the respective ear of the ratio of the loudspeaker transfer functions by the headphone transfer function, the filters being adapted to apply an impedance filtering function over a frequency domain to compensate for directional cues for the left and right ears of the listening subject as a function of virtual source angles during headphone virtual sound reproduction.

2. The method of claim 1 further comprising constraining the frequency domain to a frequency range of between 3 kHz to 10 kHz.

3. The method of claim 1 wherein the method comprises designing a time-domain filter by modeling a magnitude response and phase using one of: a linear-phase design or minimum phase design.

4. The method of claim 1 wherein the listening subject comprises a head and torso (HATS) manikin, the method further comprising:

placing the manikin centrally in the room surrounded by the loudspeakers;

placing the headphones on the manikin;

transmitting acoustic signals through the loudspeakers and headphones for reception by microphones placed in or proximate the headphones;

deriving measurements of the transfer functions by deconvolving the received acoustic signals with the transmitted signals to obtain binaural room impulse responses (BRIRs) for the loudspeaker blocked ear canal and open ear canal transfer functions; and converting the BRIRs to gated head related transfer function (HTRF) impulses.

5. The method of claim 4 further comprising:

placing subminiature microphones in cylindrical foam inserts placed in ear canal entrances of the manikin;

measuring headphone sound response through the subminiature microphones; and correcting the headphone sound response to match a flat frequency response pressure microphone through a fractional octave smoothing and minimum-phase equalization component.

6. The method of claim 4 further comprising:

measuring a Headphone-Ear-Transfer-Function for each of a plurality of headphones by placing a selected headphone on the manikin a plurality of times;

measuring a transfer function/impulse response for both ears of the manikin for each placement; and deriving an average response by RMS (root mean squared) averaging the magnitude frequency response of both ears and all placements for each respective headphone to generate a single headphone model for each headphone.

7. The method of claim 6 further comprising:

storing each headphone model in a networked storage device accessible to client computers and mobile devices over a network; and downloading a requested headphone model to a target client device upon request by the client device.

8. The method of claim 7 wherein the networked storage device comprises a cloud-based server and storage system.

9. The method of claim 7 wherein the requested headphone model is selected from a user of the client device through a selection application configured to allow the user to identify and download an appropriate headphone model.

10. The method of claim 7 further comprising:

automatically detecting a make and model of headphone attached to the client device; and downloading a respective headphone model as the requested headphone model based on the detected make and model of headphone, the headphone comprising one of an analog headphone and a digital headphone.

11. The method of claim 1, wherein for each ear the frequency-domain filter is derived as a first filter transfer curve for a headphone over a frequency domain to compensate for directional cues for the left and right ears of a listening subject as a function of virtual source angles during headphone virtual sound reproduction, the method further comprising:

deriving additional filter transfer curves for the headphone by changing placement of the headphone relative to a listening device;

deriving an average response for the headphone by RMS (root mean squared) averaging the magnitude frequency response of the first filter transfer curve and additional filter transfer curves to generate a single headphone model for each headphone; and applying the average response to a virtualizer for rendering of audio content to a listener through the headphone.

12. The method of claim 11 further comprising:

deriving average response curves as respective headphone filter models for a plurality of different headphones differentiated by type, make, and model;

storing each headphone filter model in a networked storage device accessible to client computers and mobile devices over a network; and downloading a requested headphone filter model to a target client device upon request by the client device.

13. A system comprising:

an audio renderer rendering audio for playback;

a headphone coupled to the audio renderer receiving the rendered audio through a virtualizer function;

a memory storing respective filters for left and right ears for use by the headphone, the filters being configured to compensate for directional cues for the left and right ears of a listener as a function of virtual source angles during headphone virtual sound reproduction, the filters having being obtained by the method of claim 1.

14. The system of claim 13 wherein the renderer comprises part of a digital audio processing system, and wherein the audio comprises channel-based audio and object-based audio including spatial cues for reproducing an intended location of a corresponding sound source in three-dimensional space relative to the listener.

15. The system of claim 13 wherein the memory storing the filter comprises a data storage device accessible to an audio playback device coupled to and playing the rendered audio through the headphones.

16. The system of claim 13 wherein the memory storing the filter comprises a memory storage unit integrated in the headphones.

17. The system of claim 13 wherein the filter comprises one of a plurality of filters, and wherein the filter is loaded into the memory by a detection component detecting a make and model of the headphone.

18. The system of claim 17 wherein the detection component comprises one of: a user selected command interface, and an automated detection component.

19. The system of claim 18 wherein the automated detection component utilizes one of: electrical characteristics of the headphones, and digital data transmitted from the headphones.

20. A method comprising:

rendering audio for playback through a headphone;

receiving the audio in a virtualizer for playback through the headphone;

loading respective filters for left and right ears for use by the headphone into a memory associated with the headphone, the filters being configured to compensate for directional cues for the left and right ears of a listener as a function of virtual source angles during headphone virtual sound reproduction and having being obtained by the method of claim 1.

* * * * *